US007193363B2

(12) United States Patent
Kawashima

(10) Patent No.: US 7,193,363 B2
(45) Date of Patent: Mar. 20, 2007

(54) FLAT RARE GAS DISCHARGE LAMP WITH VARIABLE OUTPUT LIGHT COLOR, ILLUMINATION INSTRUMENT COMPRISING IT, AND ITS OPERATING METHOD

(75) Inventor: Yasuki Kawashima, Shinagawa-ku (JP)

(73) Assignee: NEC Corporation, Tokyo (JP)

( * ) Notice: Subject to any disclaimer, the term of this patent is extended or adjusted under 35 U.S.C. 154(b) by 145 days.

(21) Appl. No.: 10/517,374

(22) PCT Filed: Jun. 13, 2003

(86) PCT No.: PCT/JP03/07528

§ 371 (c)(1),
(2), (4) Date: Dec. 10, 2004

(87) PCT Pub. No.: WO03/107391

PCT Pub. Date: Dec. 24, 2003

(65) Prior Publication Data

US 2005/0242739 A1 Nov. 3, 2005

(30) Foreign Application Priority Data

Jun. 14, 2002 (JP) ..... 2002-174380

(51) Int. Cl.
*H01J 1/62* (2006.01)

(52) U.S. Cl. ..... 313/509; 313/512; 313/634; 313/631; 313/607

(58) Field of Classification Search ..... None
See application file for complete search history.

(56) References Cited

U.S. PATENT DOCUMENTS 6,259,214 B1 * 7/2001 Doell et al. ..... 315/246
2002/0027412 A1 * 3/2002 Yoshida et al. ..... 313/486
2002/0175633 A1 * 11/2002 Makino ..... 315/169.1

FOREIGN PATENT DOCUMENTS

| | | |
|---|---|---|
| JP | S57-190651 U | 12/1982 |
| JP | H06-076801 A | 3/1994 |
| JP | H06-310099 A | 11/1994 |

(Continued)

*Primary Examiner*—Tuyet Thi Vo
(74) *Attorney, Agent, or Firm*—Sughrue Mion, PLLC

(57) ABSTRACT

The flat noble-gas discharge lamp of the present invention includes an outer enclosure that has a rear-surface substrate and a light-extraction-side substrate that is positioned to confront the rear-surface substrate. A first fluorescent film and a second fluorescent film that emit visible light of different colors are formed on respective inner surfaces of the rear-surface substrate and the light-extraction-side substrate; a first electrode and a second electrode are formed at a distance from each other on the rear-surface substrate; and a third electrode that confronts both of the first electrode and second electrode is formed on the light-extraction-side substrate. The application of voltage between the first electrode and the second electrode generates a glow discharge based on dielectric barrier discharge in the vicinity of the rear-surface substrate inside the outer enclosure, while the application of voltage between the first and second electrodes and the third electrode generates a glow discharge in the central region of the interior of the outer enclosure; and the ultraviolet rays that are generated by the glow discharge are converted to visible light by the first and second fluorescent materials.

16 Claims, 3 Drawing Sheets

FOREIGN PATENT DOCUMENTS

| | | | |
|---|---|---|---|
| JP | H07-006734 | A | 1/1995 |
| JP | H07-029549 | A | 1/1995 |
| JP | H07-085843 | A | 3/1995 |
| JP | H10-003887 | A | 1/1998 |
| JP | 2001-266801 | A | 9/2001 |

* cited by examiner

FLAT RARE GAS DISCHARGE LAMP WITH VARIABLE OUTPUT LIGHT COLOR, ILLUMINATION INSTRUMENT COMPRISING IT, AND ITS OPERATING METHOD

TECHNICAL FIELD

The present invention relates to a flat noble-gas discharge lamp, and more particularly to a variable-color flat noble-gas discharge lamp that is capable of switching the color that is emitted by a single flat noble-gas discharge lamp among a plurality of colors.

BACKGROUND ART

A discharge lamp that uses the luminescence of a fluorescent material such as a fluorescent lamp is basically a construction that causes a glow discharge inside an airtight discharge space in which a low-pressure gas has been sealed, converts the ultraviolet rays that are emitted by this glow discharge to visible light by means of a fluorescent film that is provided on the inner walls of an enclosure, and extracts this visible light to the outside from the translucent portion of the enclosure. One such discharge lamp is a variable-color discharge lamp that is capable of switching the color of the output light of a single discharge lamp among a plurality of colors. The color of output light of a discharge lamp is chiefly determined by the wavelength of the ultraviolet rays that are generated from the glow discharge and by the fluorescent material that is excited by these ultraviolet rays. If the variable-color discharge lamps of the prior art are considered in terms of the sealed gas, which affects the wavelength of the ultraviolet rays that are generated by the glow discharge, the fluorescent material, the electrode structure that relates to the switching of the output light color, and the lighting method, the types of variable-color discharge lamps that are known thus far are as follows:

First to be considered are variable-color discharge lamps that use a plurality of fluorescent materials, each having a different emitted color. The plurality of fluorescent materials are in some cases used in mixtures and in others stacked in a layered structure. Alternatively, the materials are individually formed in separate locations inside the discharge space.

As an example, Japanese Patent Laid-Open Publication No. 2001-266801 discloses a variable-color discharge lamp that uses a mixture of two types of fluorescent materials, a fluorescent material for mercury light emission and a fluorescent material for xenon light emission, and further, that uses a gas mixture of mercury vapor and xenon gas for the discharge gas (Prior Art Example 1). In this discharge lamp, making the waveform of the voltage that is applied between electrodes a sine wave tends to excite the mercury while making the waveform a pulse wave tends to excite the xenon, and the color of the output light can be switched by changing the rate at which the two types of fluorescent materials are excited. This variable-color discharge lamp employs two types of fluorescent materials and a gas mixture of two types of gases and includes one pair of electrodes. The position of formation of the discharge does not vary within the lamp.

In the same publication, prior art is also disclosed in which the color of emitted light that is obtained outside a lamp is varied by: employing a container having a double-layer structure that includes an outer tube and an inner tube that is inserted inside the outer tube, applying a fluorescent material that emits red light to the inside of the outer tube and applying a fluorescent material that emits green light to the inside of the inner tube, and then making the waveform of the voltage that is applied between the electrodes a sine wave or a pulse wave to switch between generating a positive column of discharge between the outer tube and inner tube or generating a positive column inside the inner tube (Prior Art Example 2).

This variable-color discharge lamp is similar to the first example of the prior art with regard to the use of two types of fluorescent materials and a single pair of electrodes, but differs regarding the use of xenon as a single sealed gas. In addition, the principal of the operation of this variable-color discharge lamp further differs in that the two types of fluorescent materials are separately provided at separate locations inside the discharge enclosure, and in that, through the design of the electrode construction, the region in which the positive column of discharge forms within the discharge enclosure is changed in accordance with the waveform of the applied voltage. One of the pair of electrodes of this discharge lamp is an inner electrode similar to the first example of the prior art, and the other electrode is an outer surface electrode that is constituted by a thin threadlike conductor that is wound in a spiral around the outside of the outer tube.

Japanese Patent Laid-Open Publication No. H07-085843 similarly discloses a variable-color discharge lamp that employs two types of fluorescent materials that emit light of different colors (Prior Art Example 3). This discharge lamp employs xenon as a single sealed gas and a pair of inner electrodes similar to the electrodes in the first example of the prior art, but varies the rate of contribution to the emitted light made by each of the fluorescent materials by varying the crest value of the pulse voltage that is applied between the electrodes.

Japanese Patent Laid-Open Publication No. H06-076801 discloses a variable-color discharge lamp that, as in the third example of the prior art, employs two types of fluorescent materials that are excited by ultraviolet rays of different wavelengths and that varies the rate of contribution to the emitted light made by each fluorescent material by varying the conditions of the voltage that is applied between the electrodes (Prior Art Example 4). In the discharge lamp according to this fourth example of the prior art, varying the duty ratio of applied pulses causes a change in the distribution of the wavelengths of the ultraviolet rays that are emitted by the mercury of the sealed gas and thus changes the light-emitting intensity of each of the fluorescent materials.

Variable-color discharge lamps that employ only one type of fluorescent material are also known. The above-described first to fourth examples of the prior art employed a plurality of types of fluorescent materials that each emits light of a different color, but Japanese Patent Laid-Open Publication No. H07-029549, Japanese Patent Laid-Open Publication No. H06-310099, and Japanese Patent Laid-Open Publication No. H07-006734 each disclose discharge lamps that are capable of varying the color of emitted light while employing only one type of fluorescent material (Prior Art Example 5). These discharge lamps are all similar in that they each employ two pairs of electrodes and a gas mixture of two types of gas as the sealed gas, and further, in that they vary the color of emitted light by switching the electrode pair that causes discharge.

For example, the variable-color discharge lamp that is described in Japanese Patent Laid-Open Publication No. H06-310099 has a pair of inner electrodes inside and at both ends in the longitudinal direction of a straight-tube bulb. In addition to these inner electrodes, the lamp is further provided with a pair of outer-surface electrodes on the outer surface of the bulb. Further, a gas mixture of two types of gas such as mercury and neon that emit ultraviolet rays of different wavelengths is sealed inside the bulb. In this discharge lamp, the application of a high-frequency voltage between the inner electrodes causes mercury vapor to be ionized and excited in a positive column that is generated between the inner electrodes to produce ultraviolet rays, and these ultraviolet rays excite the fluorescent material to produce visible light of a color that accords with the characteristics of the fluorescent material. When high-frequency power is applied between the outer-surface electrodes, on the other hand, a glow discharge is generated by the dielectric barrier discharge between the outer-surface electrodes, neon is ionized and excited in the portion of this negative glow, and visible light of the red color peculiar to neon is generated and extracted to the outside.

Japanese Patent Laid-Open Publication No. H10-003887 discloses a noble-gas discharge lamp (Prior Art Example 6) that uses two pairs of electrodes as in the fifth example of the prior art and that is further capable of toning the color of the emitted light over a wide range by switching the electrode pairs that are caused to discharge. In contrast to the above-described first to fifth examples of the prior art, this discharge lamp is a flat noble-gas discharge lamp. In this noble-gas discharge lamp, a plurality of first electrodes and second electrodes that are in an electrically insulated state from the first electrodes are alternately arranged on the inner walls on the discharge-space side of a rear-surface substrate having a flat shape. Third electrodes having a size that corresponds to the entire region in which the first and second electrodes are arranged on the rear-surface substrate are provided on the outer surface of the light-extraction side of the substrate that confronts the rear-surface substrate. A first fluorescent material film is provided over the first electrodes of the rear-surface substrate, a second fluorescent material film that emits light of a different color than the first fluorescent material film is provided over the second electrodes, and the discharge space is charged with the single gas xenon.

In the flat noble-gas discharge lamp of this sixth example of the prior art, a lighting operation in which a high-frequency voltage is applied between the first electrodes of the rear-surface substrate and the third electrodes of the light-extraction side substrate and a lighting operation in which high-frequency voltage is applied between the second electrodes of the rear-surface substrate and the third electrodes of the light-extraction-side substrate are executed in time divisions. The color of the emitted light can then be toned over a wide range by controlling such factors as the proportion of the lengths of the intervals of carrying out each of the lighting operations and the frequency and voltage value of the voltage applied in each lighting operation.

In contrast to the discharge lamps described in the above-described first to fifth examples of the prior art, which all used straight-tube bulbs, the construction of this noble-gas discharge lamp of the sixth example of the prior art differs significantly because it is a flat noble-gas discharge lamp that employs a bulb of flat-panel construction. As previously described, a variety of a variable-color discharge lamps are known in the prior art that are each capable of varying the color of emitted light over a plurality of colors using a single discharge lamp, but the flat noble-gas discharge lamp of the sixth example of the prior art in particular has a flat bulb and is therefore better suited for obtaining a thin-surface light source than the variable-color discharge lamps of the first to fifth examples of the prior art that employ cylindrical straight-tube bulbs. Moreover, the flat noble-gas discharge lamp of the sixth example of the prior art is further capable of widely varying the color of emitted light to an extent that is virtually free of stepped gradations.

However, in the flat noble-gas discharge lamp of the sixth example of the prior art, two types of fluorescent materials that produce emitted light of different colors must be applied in prescribed patterns to each of the rear-surface substrate and light-extraction-side substrate at each time, and the fabrication steps are therefore complex and fabrication is correspondingly difficult. In addition, two power supply devices must be operated in time divisions to realize color toning, the operating intervals of each of the power supply devices when carrying out the time-division operation, i.e., the lighting interval by the first electrode and third electrode and the lighting interval by the second electrode and the third electrode, must be switched in time intervals sufficiently short to prevent flicker that is noticeable to the eye, and the frequency and voltage level of the output voltages of the power supply devices are also changed in each lighting interval, and due to all of these factors, the power supply devices and lighting control are inevitably complex. Thus, although the flat noble-gas discharge lamp of the sixth example of the prior art enables switching of the color of the emitted light with dramatic diversity, this diversity comes at the cost of the above-described side effects.

In contrast, when a flat noble-gas discharge lamp is used as the light source of an illumination device, it can be assumed that the discharge lamp need only supply two and at the very most four colors of emitted light, that the lamp need only allow switching and has no need for color toning that is free of stepped gradations, and further that the lamp be of simple construction that does not entail complex fabrication procedures. For example, switching the color of the emitted light of an illumination device to a daytime color in the morning and during the day, to a light-bulb color at night, to a color tinged with blue that provides a strong sense of coolness during the summer, and then to a color tinged with warm red during the winter can produce a desired atmosphere by switching the illumination color to a color that is appropriate to the season and time of day. When a discharge lamp is used for such a purpose, there is no need to allow switching of the illumination color over such a wide range of illumination colors. In addition, switching of the power supply device can be adequately realized by a construction that allows manual operation of a mechanical switch.

DISCLOSURE OF THE INVENTION

It is therefore an object of the present invention to provide a flat, variable-color noble-gas discharge lamp that allows switching of the color of emitted light between two colors or four colors, that has a simple construction, and that can be fabricated by a simple fabrication process.

The flat noble-gas discharge lamp of the present invention that can achieve the above-described objects includes: an outer enclosure having a flat rear-surface substrate and a flat front-surface substrate that confronts this rear-surface substrate and that is separated from the rear-surface substrate by a prescribed distance, and a gas that is hermetically sealed inside this outer enclosure. A first fluorescent material film and a second fluorescent material film are provided on the rear-surface substrate and the front-surface substrate, respectively, these fluorescent materials each emitting visible light of a different color. In addition, a plurality of electrodes are provided on the rear-surface substrate and on the front-surface substrate; and these electrodes include electrodes that function as electrode pairs that are created by combining electrodes among these electrodes, these electrode pairs including two types of electrode pairs that are formed by changing the manner of combining and for which the position of the glow discharge that is generated when voltage is applied between the electrode pairs varies within the space from the rear-surface substrate to the front-surface substrate.

Accordingly, in this flat noble-gas discharge lamp, switching the electrode pair to which voltage is applied between the two types of electrode pairs changes the position at which glow discharge is generated and thus changes the proportion of the first fluorescent material and the second fluorescent material that is excited, and as a result, changes the ratio between light that is emitted from the first fluorescent material and light that is emitted from the second fluorescent material, and thus switches the color of the extracted visible light between two colors.

In this flat noble-gas discharge lamp, a single type of fluorescent material may be formed on each of the rear-surface substrate and front-surface substrate, and the process of fabricating this discharge lamp can therefore be made more convenient than a fabrication process in which films of a plurality of types of fluorescent materials are formed in stacked layers or formed in different regions on a single substrate as was seen in the previously described prior art.

In the flat noble-gas discharge lamp of the present invention, glow discharge is generated based on dielectric barrier discharge and therefore requires a dielectric. This dielectric may be formed as a dielectric film on the electrodes when forming the electrodes on the inner surfaces of the outer enclosure, or alternatively, in a case in which the electrodes are formed on the outer surfaces of the outer enclosure, the rear-surface substrate itself or front-surface substrate itself can be used as a dielectric for bringing about the dielectric barrier discharge. The latter construction has the advantage of enabling omission of the process of forming the dielectric film.

More specifically, the plurality of electrode pairs can be a first electrode and a second electrode that are arranged at a distance from each other on the rear-surface substrate, and a third electrode that is provided in an area of the front-surface substrate that includes the area that confronts the first electrode and second electrode. In this case, the application of voltage to the electrode pair constituted by the first electrode and the second electrode causes a glow discharge to be generated at a position that is close to the rear-surface substrate, and the first fluorescent material is therefore more strongly excited than the second fluorescent material. On the other hand, the application of voltage to an electrode pair that is constituted by the first and second electrodes and the third electrode causes a glow discharge to be generated that is in the central area between the rear-surface substrate and the front-surface substrate, and the first fluorescent material and second fluorescent material can therefore be excited to an equal degree.

In the present invention, the gas that is sealed inside the outer enclosure can be a noble gas that does not include mercury, whereby a discharge lamp can be obtained in which the fluctuation in the intensity of emitted light that accompanies change in temperature can be reduced, and further, that has superior characteristics regarding the rise in the intensity of emitted light immediately following lighting.

The color of the extracted visible light can be also switched by using a gas mixture of two types of noble gas as the gas that is sealed within the outer enclosure, these two noble gases each calling for the application of a different voltage between the electrode pairs to generate a glow discharge for exciting the corresponding gas, and these two noble gases when excited each emitting ultraviolet rays having a different wavelength; and by switching the voltage that is applied between electrode pairs. In other words, switching the voltage that is applied between electrodes pairs between two voltages, i.e., a high and low voltage that strongly excite either of the two types of noble gas, changes the ultraviolet rays that are generated from the noble gas, and accordingly, changes the wavelength of the ultraviolet rays that excite the fluorescent material, and thus, changes the color of the visible light that is emitted from the fluorescent material. Combining this switching of the applied voltage with the above-described switching of the electrode pairs to which voltage is applied allows the color of light that is emitted from the discharge lamp to be switched among four colors.

As the two types of noble gas that call for different voltages to be applied between electrodes in order to generate a glow discharge for exciting the corresponding gas, and that, when excited, radiate ultraviolet rays having different wavelengths, xenon and krypton may be used.

BEST MODE FOR CARRYING OUT THE INVENTION

Embodiments of the present invention are next described with reference to the accompanying figures.

Figure 1A:
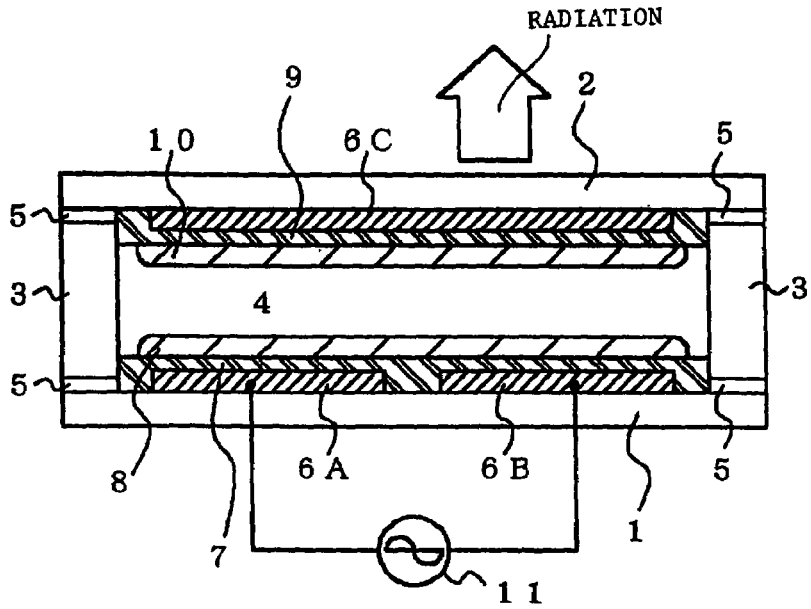
FIGS. 1*a* and 1*b* are sectional views of the flat noble-gas discharge lamp of the first embodiment of the present invention and give schematic representations of the connection methods that correspond to the two types of lighting methods.

FIG. 1*a* is a sectional view of the flat noble-gas discharge lamp of the first embodiment of the present invention. This flat noble-gas discharge lamp includes: flat rear-surface substrate 1 composed of an electrically insulating material such as glass; flat light-extraction-side substrate 2 that confronts rear-surface substrate 1 at a prescribed distance, and frame 3 that is provided between these two substrates along the periphery of the two substrates, whereby a flat and box-like outer enclosure is formed in which interior hollow discharge chamber 4 is formed. Light-extraction-side substrate 2 is produced from, for example, a material such as a transparent glass plate that is translucent and moreover electrically insulating.

Frame 3 is bonded to each of rear-surface substrate 1 and light-extraction-side substrate 2 by interposed bond layers 5 to produce an airtight seal, and a low-pressure gas is sealed inside discharge chamber 4 that is thus hermetically sealed. This sealed gas is a noble gas that does not contain mercury vapor. In the present embodiment, xenon is sealed at a pressure of 15 kPa. Since the sealed gas does not contain mercury, a discharge lamp can be obtained that exhibits little of the fluctuation in the intensity of emitted light that accompanies changes in temperature and that has superior characteristics regarding the rise in the intensity of emitted light immediately after lighting. Further, the obtained discharge lamp will not cause contamination of the environment.

Two electrodes, first electrode 6A and second electrode 6B, are provided at a prescribed distance from each other on the inner walls of the discharge chamber 4 side of rear-surface substrate 1. These two electrodes 6A and 6B are in an electrically insulated state from each other and voltage can therefore be applied between the two electrodes. Further, although not shown in the figure, the two electrodes 6A and 6B extend substantially from end to end of the surface of rear-surface substrate 1 that confronts the inside of discharge chamber 4 in the direction of depth of discharge chamber 4 (the direction that is perpendicular to the page). First dielectric film 7 that is composed of, for example, glass is formed on electrodes 6A and 6B over substantially the entire surface of rear-surface substrate 1 that confronts the interior of discharge chamber 4, and substantially the entire surface of first dielectric film 7 is further covered by tightly bonded first fluorescent film 8.

Third electrode 6C is provided on the surface of light-extraction-side substrate 2 that is directed toward discharge chamber 4. This third electrode 6C is composed of, for example, a translucent and conductive material such as ITO. Although third electrode 6C is a single electrode, it has a size that covers the area that confronts the entirety of first electrode 6A and second electrode 6B on rear-surface substrate 1. Further, electric potential can be independently applied to third electrode 6C separately from first electrode 6A and second electrode 6B. Second dielectric film 9 is provided to closely bond to substantially the entire surface of this third electrode 6C, and second fluorescent film 10 is further formed over substantially the entire surface of second dielectric film 9.

First fluorescent film 8 and second fluorescent film 10 act to convert the ultraviolet rays that are radiated by xenon gas in discharge chamber 4 during glow discharge to visible light, and fluorescent materials that emit light of different colors are used for first fluorescent film 8 and second fluorescent film 10. In the present embodiment, a fluorescent material (Y, Gd) $BO_3$: Eu that emits red visible light is used for first fluorescent film 8 on rear-surface substrate 1, while the fluorescent material that is used for second fluorescent film 10 on light-extraction-side substrate 2 emits white visible light and is a mixture of a fluorescent material (Y, Gd) $BO_3$: Eu that emits red, fluorescent material $LaPO_4$: Tb that emits green, and fluorescent material $BaMgAl_{10}O_{17}$: Eu that emits blue.

When lighting the discharge lamp in the present embodiment, a high-frequency sine-wave voltage or a positive and negative bipolar pulse voltage having a frequency of, for example, approximately 40 kHz and a voltage of 1000 $V_{P-P}$ is applied between electrode pairs constituted by appropriate combinations of first electrode 6A, second electrode 6B and third electrode 6C. The application of voltage between the electrode pairs generates a glow discharge that is based on dielectric barrier discharge inside discharge chamber 4 by way of first dielectric film 7 and second dielectric film 9, whereby first fluorescent film 8 and second fluorescent film 10 are excited by the ultraviolet rays that are emitted mainly from the positive column of the glow discharge, and light is thus radiated from each of fluorescent films 8 and 10.

Here, two methods exist for combining the electrodes in which discharge is to be generated, i.e., for making electrode pairs. As shown in FIG. 1*a*, the first method (hereinbelow referred to as "lighting method A") uses only first electrode 6A and second electrode 6B on rear-surface substrate 1 and applies voltage between the two electrodes by means of power supply device 11. Since two electrodes 6A and 6B are both formed on the inner wall of rear-surface substrate 1, lighting by means of this lighting method A generates a dielectric barrier discharge along rear-surface substrate 1, and the glow discharge occurs in extreme proximity to rear-surface substrate 1. As a result, first fluorescent film 8 on rear-surface substrate 1 is more strongly excited than second fluorescent film 10 on light-extraction-side substrate 2, and the color of light that is emitted to the outside through light-extraction-side substrate 2 is a color that is strongly dependent on the color of emitted light of first fluorescent film 8.

Figure 1B:
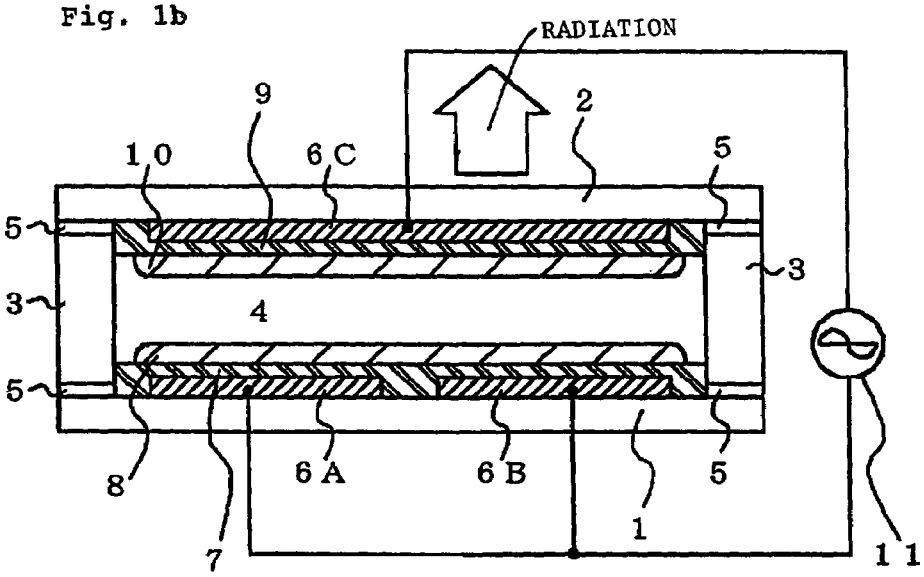

On the other hand, as shown in FIG. 1*b*, the second method (hereinbelow referred to as "lighting method B") is a method in which the electrical potential of first electrode 6A and second electrode 6B on rear-surface substrate 1 is made the same and voltage is applied by means of power supply device 11 between third electrode 6C on light-extraction-side substrate 2 and first and second electrodes 6A and 6B that are at the same potential. When lighting by means of this lighting method B, a high-frequency voltage is applied between third electrode 6C of light-extraction-side substrate 2 and first and second electrodes 6A and 6B of rear-surface substrate 1. Accordingly, the dielectric barrier discharge occurs between light-extraction-side substrate 2 and rear-surface substrate 1, and the positive column of the glow discharge is generated in substantially the center of the space from light-extraction-side substrate 2 to rear-surface substrate 1. As a result, first fluorescent film 8 on rear-surface substrate 1 and second fluorescent film 10 on light-extraction-side substrate 2 are excited at substantially the same level, and the color of light that is extracted to the outside is dependent on both first fluorescent film 8 and second fluorescent film 10.

Figure 1C:
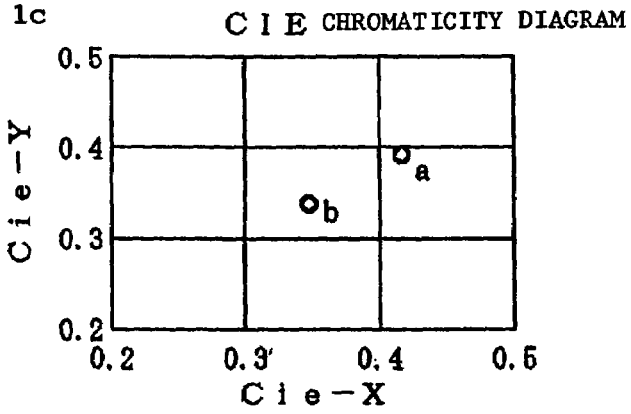
FIG. 1*c* is a chart showing the chromaticity of the colors that are obtained for each of the connection methods of FIGS. 1*a* and 1*b*.

In the present embodiment, when a discharge lamp is lit by lighting method A (FIG. 1*a*), or more specifically, when a bipolar pulse wave having a frequency of 40 kHz and a voltage of 2000 $V_{P-P}$ is applied between first electrode 6A and second electrode 6B, an output light is obtained having a color such as is marked by the small circle "a" in the CIE chromaticity diagram shown in FIG. 1*c*. In contrast, when the discharge lamp is lit by lighting method B (FIG. 1*b*), or more specifically, when a bipolar pulse wave having a frequency of 40 kHz and a voltage of 2000 $V_{P-P}$ is applied between third electrode 6C and the two electrodes, first electrode 6A and second electrode 6B, an output light is obtained having a color such as is marked by small circle "b" in the CIE chromaticity diagram of FIG. 1*c*.

Thus, enabling this switching of the combinations of first electrode 6A, second electrode 6B, and third electrode 6C and then altering the method of combining the electrodes causes a change in the position in which the glow discharge forms between rear-surface substrate 1 and light-extraction-side substrate 2, which in turn causes a change in the proportion of the contributions of first fluorescent film 8 and second fluorescent film 10 in the light that is emitted to the outside, and thus enables the color of the emitted light to be switched between two colors.

Figure 2:
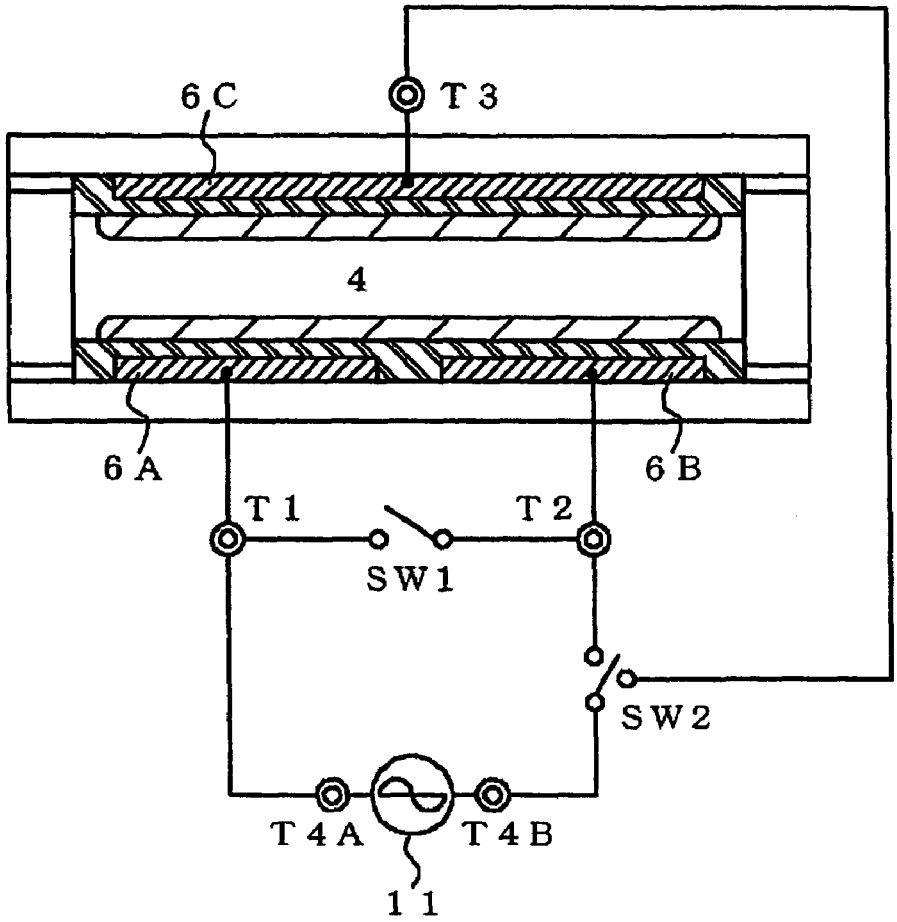
FIG. 2 gives a schematic representation of the construction of the illumination device of the first embodiment.

Here, FIG. 1*a* and FIG. 1*b* represent lighting method A and lighting method B by simple wiring diagrams, but the provision of, for example, an electrical circuit that incorporates a means for switching the combinations of electrodes 6A, 6B and 6C as shown in FIG. 2 enables switching of the color of emitted light through the use of a single power supply device 11. In other words, in the construction that is shown in FIG. 2, ON/OFF switch SW1 is inserted between external terminal T1 of first electrode 6A (a terminal that is provided outside discharge chamber 4) and external terminal T2 of second electrode 6B. External terminal T1 of electrode 6A is then connected to one output terminal T4A of power supply device 11. In addition, switch SW2 that allows the connection of output terminal T4B to be switched to either electrode 6B or electrode 6C is inserted between the other output terminal T4B of power supply device 11, external terminal T2 of second electrode 6B, and external terminal T3 of third electrode 6C.

In this construction, when flat noble-gas discharge lamp, which is the light source, is lit by lighting method A, ON/OFF switch SW1 is set to OFF and switch SW2 is set to external terminal T2 of second electrode 6B, whereby the high-frequency voltage from power supply device 11 is applied between first electrode 6A and second electrode 6B. Alternatively, when lighting by lighting method B, ON/OFF switch SW1 is set to ON and switch SW2 is set to external terminal T3 of third electrode 6C. By means of this operation of the switches, the flat noble-gas discharge lamp is switched such that the high-frequency voltage from power supply device 11 is applied between first and second electrodes 6A and 6B and third electrode 6C. The switching operation in the above-described switches SW1 and SW2, in contrast with the switching in the sixth example of the prior art, does not necessitate switching by a time-division operation at a speed that is not noticeable to the eye. Accordingly, this switching operation can be adequately achieved by the manual operation of a mechanical switch, and there is absolutely no need for a complex control system such as electronic circuitry for effecting control.

The fabrication of the flat noble-gas discharge lamp of the present embodiment does not necessitate any particularly difficult processes, and the discharge lamp can be fabricated by, for example, employing fabrication techniques that are known in the art, as will be described hereinbelow. Specifically, rear-surface substrate 1 composed of a flat plate of soda-lime glass is first prepared, following which a silver paste is screen-printed on one surface of this rear-surface substrate 1 in the pattern of first electrode 6A and second electrode 6B and then sintered at a prescribed temperature to obtain first electrode 6A and second electrode 6B.

A paste-like material that contains lead glass is next screen printed in the pattern of first dielectric film 7 over substantially the entire surface of rear-surface substrate 1, which includes first electrode 6A and second electrode 6B, and then sintered at a prescribed temperature to obtain first dielectric film 7.

First fluorescent film 8 is next formed on first dielectric film 7. For this purpose, a paste-like material in which a fluorescent material, a binder, and a solvent are mixed is screen printed in the pattern of first fluorescent film 8 over first dielectric film 7 and then sintered at a prescribed temperature. In the present embodiment, a red fluorescent material is used for first fluorescent film 8.

A paste-like material of frit seal glass is then screen printed in a frame pattern on the portions (the outer periphery of the substrate) of rear-surface substrate 1 that are bonded to frame 3 and sintered at a prescribed temperature to obtain bonding layer 5.

Third electrode 6C, second dielectric film 9, and second fluorescent film 10 are formed in advance on light-extraction-side substrate 2 independently of the processing of rear-surface substrate 1. For this purpose, light-extraction-side substrate 2 that is composed of a flat plate of transparent soda-lime glass is first prepared, following which an ITO thin-film is deposited over the entire surface of one side of this substrate 2 by a sputtering method. This thin-film is then etched in the pattern of third electrode 6C using photolithographic techniques to obtain third electrode 6C.

Next, as in the processing of rear-surface substrate 1, a paste-like material that contains lead glass is screen printed in the pattern of second dielectric film 9 over substantially the entire light-extraction-side substrate 2, including the portion in which third electrode 6C is formed, following which light-extraction-side substrate 2 is sintered at a prescribed temperature to obtain second dielectric film 9.

Second fluorescent film 10 is next formed on second dielectric film 9. For this purpose, a paste-like material in which a fluorescent material, a binder, and a solvent are mixed is screen printed in the pattern of second fluorescent film 10 on the entirety of second dielectric film 9 and then sintered at a prescribed temperature. Here, a fluorescent material that emits white light by mixing red, green, and blue is used for second fluorescent film 10 in the present embodiment.

Next, as with rear-surface substrate 1, a paste-like material of frit seal glass is formed in a frame pattern on portions of light-extraction-side substrate 2 that are to be bonded to frame 3 and sintered at a prescribed temperature to obtain bonding layer 5.

Then, rear-surface substrate 1 and light-extraction-side substrate 2 on which the electrodes, dielectric films, and fluorescent films have been formed in prescribed patterns and further, that have been sintered as necessary in the above-described processes are arranged in confrontation with the frame 3 interposed and sintered at a prescribed temperature. Rear-surface substrate 1 is thus bonded to frame 3 and light-extraction-side substrate 2 bonded to frame 3 so as to realize an airtight seal and thus form discharge chamber 4.

A low-pressure noble gas is then sealed inside discharge chamber 4, whereby the flat noble-gas discharge lamp of the present embodiment is completed. In the present embodiment, xenon is used as the sealed gas, and is sealed at a pressure of 15 kPa.

Thus, although two types of fluorescent materials are used in the fabrication of the discharge lamp of the present embodiment, each of these fluorescent materials is separately applied one type at a time to rear-surface substrate 1 and light-extraction-side substrate 2, respectively, to form patterns. As a result, the processing methods of the prior art can be followed substantially without change when forming fluorescent film 8 and fluorescent film 10 on rear-surface substrate 1 and light-extraction-side substrate 2, respectively. In other words, there is no need for a new processing method that could not be effected in the processing method of the prior art such as, for example, applying two types of fluorescent materials, one on top of the other, or forming two types of fluorescent materials on one substrate with different patterns for each fluorescent material. As a result, when compared with the fabrication of a discharge lamp of the prior art, the fabrication of the discharge lamp of the present embodiment can be easily implemented using the fabrication methods of the prior art, and although the present embodiment entails a slight increase in the number of steps for managing materials, the present embodiment entails virtually no additional complexity of processing.

As in the above-described first embodiment, a flat, noble-gas discharge lamp that allows the color of emitted light to be switched between two colors can also be obtained by the constructions of the second, third, and fourth embodiments described hereinbelow.

Figure 3:
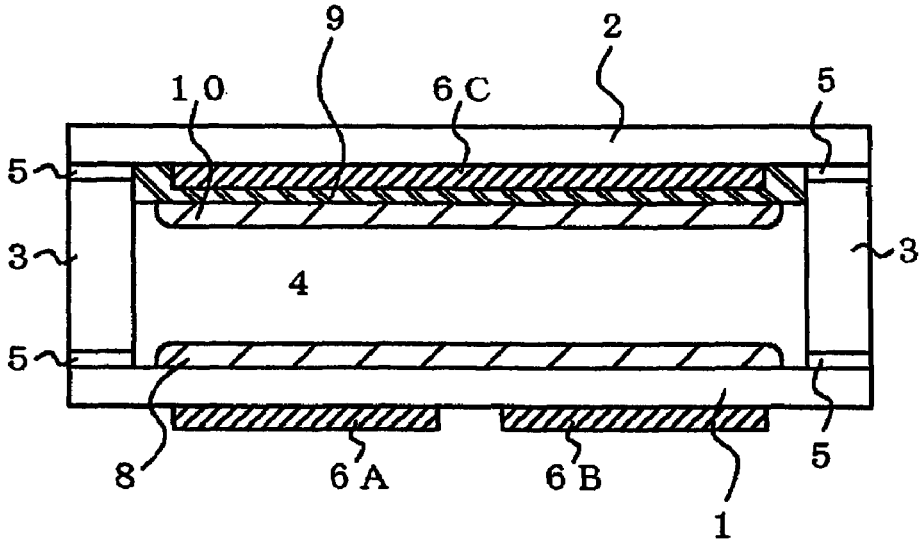
FIG. 3 is a sectional view of the flat noble-gas discharge lamp of the second embodiment.

FIG. 3 is a sectional view of a flat noble-gas discharge lamp according to the second embodiment. In this embodiment, a so-called outer electrode construction is adopted in which the two electrodes, first electrode 6A and second electrode 6B, that are arranged on rear-surface substrate 1 are provided on the outer side of rear-surface substrate 1. The adoption of this construction allows rear-surface substrate 1 itself to be used as the dielectric for generating a dielectric barrier discharge, and as a result, not only can first dielectric film 7 (refer to FIG. 1*a* or FIG. 1*b*) that was required in the first embodiment be omitted, but further, a more stable discharge can be obtained. The elimination of the need to form first dielectric film 7 allows a reduction of the number of fabrication steps and shortens the fabrication time.

Figure 4:
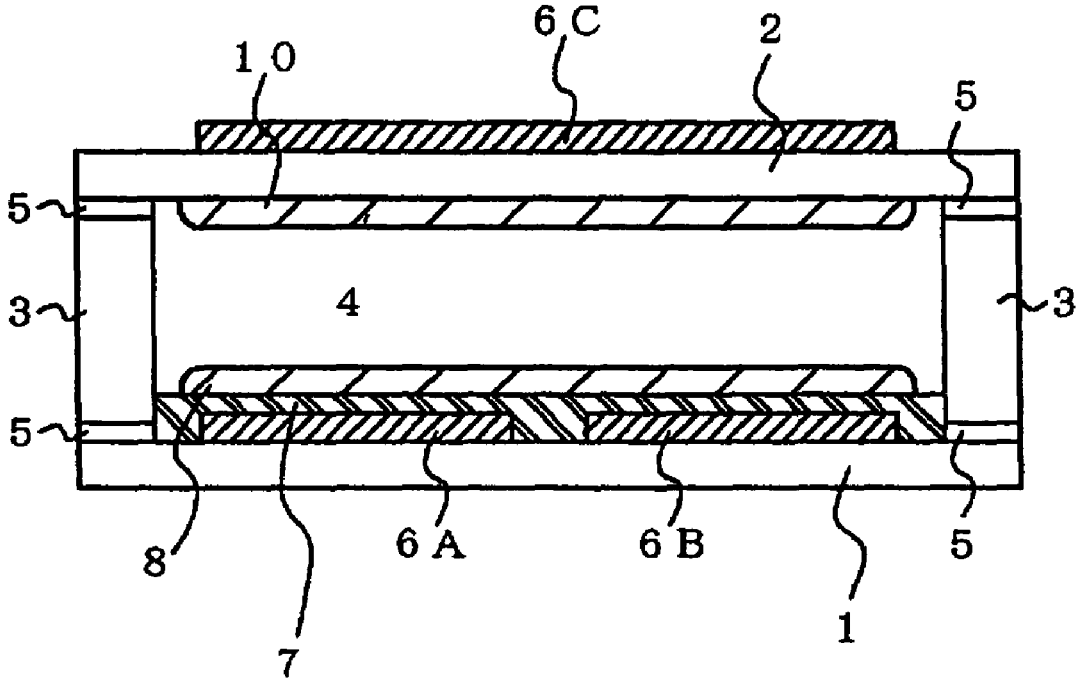
FIG. 4 is a sectional view of the flat noble-gas discharge lamp of the third embodiment.
Figure 5:
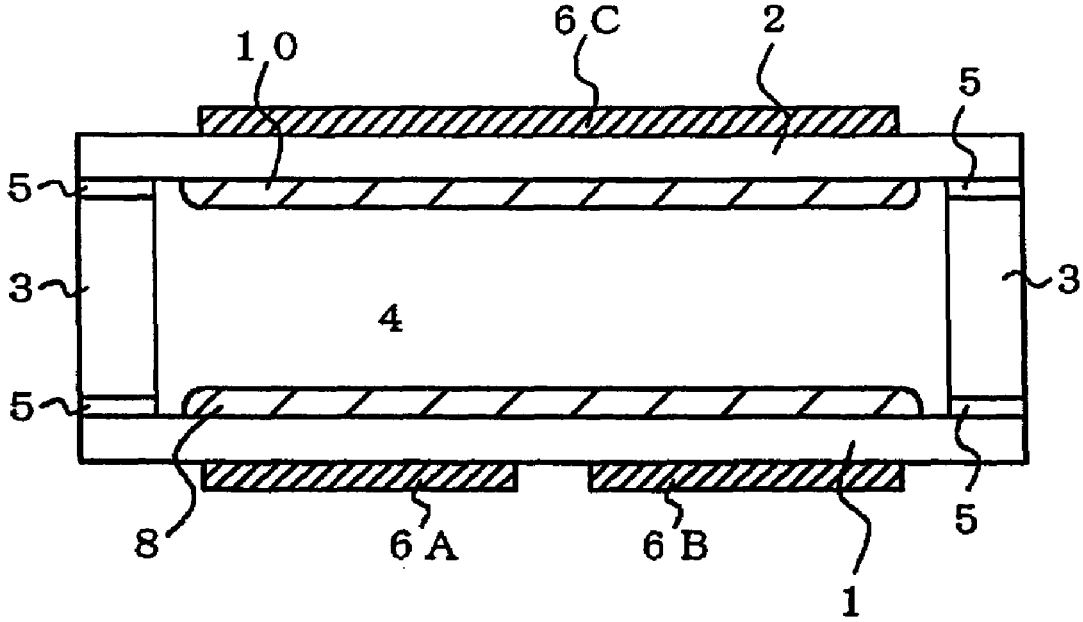
FIG. 5 is a sectional view of the flat noble-gas discharge lamp of the fourth embodiment.

As another example in which rear-surface substrate 1 or light-extraction-side substrate 2 is used as the dielectrics for generating a dielectric barrier discharge, FIG. 4 shows a sectional view of the flat noble-gas discharge lamp of the third embodiment in which third electrode 6C that is provided on light-extraction-side substrate 2 is provided as an outer-surface electrode structure and in which second dielectric film 9, which was necessary in the first embodiment, is omitted. In addition, FIG. 5 shows a sectional view of the flat noble-gas discharge lamp of the fourth embodiment in which the outer-surface electrode construction is adopted on both rear-surface substrate 1 and light-extraction-side substrate 2 and in which dielectric films are rendered completely unnecessary. As in the second embodiment, the third and fourth embodiments also allow a decrease in the number of fabrication steps and a shortening of the fabrication time.

In all of the above-described first to fourth embodiments, examples were presented in which one type of noble gas (xenon gas) is sealed inside discharge chamber 4 and the color of emitted light was switched between two colors, but the present invention is not limited to this form. As the fifth embodiment, an example is next described in which the sealed gas is a gas mixture of two types of noble gas, whereby the color of the emitted light can be switched between four colors. The flat noble-gas discharge lamp of this embodiment has the same construction as the flat noble-gas discharge lamp shown in FIG. 1*a* (or in FIG. 1*b*), but the composition of the gas that is sealed inside discharge chamber 4 is different. The sealed gas that is used in the present embodiment is a gas mixture of xenon and krypton, the total pressure being 20 kPa, the partial pressure of xenon being 10 kPa, and the partial pressure of krypton being 10 kPa.

The excitation energies of xenon and krypton are different, and the wavelengths of the ultraviolet rays emitted by these two gases therefore also differ, with krypton chiefly emitting ultraviolet rays having a wavelength of 146 nm and xenon emitting ultraviolet rays chiefly having a wavelength of 173 nm. Thus, even though the fluorescent material is the same, the color of light emitted when excited by ultraviolet rays that are radiated by krypton is different from the color of light emitted when excited by the ultraviolet rays radiated by xenon. In the present embodiment, the output voltage of power supply device 11 can be switched between high and low, the low voltage being used for exciting krypton and the high voltage being used for exciting xenon, whereby switching the value of the output voltage of the power supply device in turn switches the color of the light that is emitted by the discharge lamp between two colors. Further, combining this switching of the output voltage with the alteration of the combinations of the three types of electrodes 6A, 6B and 6C to switch the region of formation of the glow discharge as shown in the first to fourth embodiments enables switching between a total of four colors of emitted light.

In the present embodiment, the use of the same fluorescent material that was used in the first embodiment in first fluorescent film 8 and second fluorescent film 10 and the application of a bipolar pulse wave having a frequency of 40 kHz and a voltage of 500 $V_{P-P}$ between first electrode 6A and second electrode 6B produces an emitted light having a deep red color. Alternatively, the application of a bipolar pulse wave of the same frequency but with a voltage raised to 1000 $V_{P-P}$ produces a red light. Further, setting first electrode 6A and second electrode 6B at the same potential and applying a bipolar pulse wave with a frequency of 40 kHz and a voltage of 500 $V_{P-P}$ between third electrode 6C and first and second electrodes 6A and 6B produces emitted light having a daylight color. Still further, the application of a bipolar pulse wave of the same frequency but with a voltage raised to 1000 $V_{P-P}$ produces an emitted light having a light-bulb color.

In the present embodiment, a gas mixture of two types of gas was used as the sealed gas and the fabrication steps were therefore somewhat more complicated than when using a single gas, but the use of a gas mixture as the sealed gas is known in the prior art as documented by, for example, Japanese Patent Laid-Open Publication No. H06-310099, and this modification therefore does not seriously complicate the fabrication process.

In all of the above-described embodiments, a fluorescent material that emits red was used in first fluorescent film 8 and a fluorescent material that emits white light, which is a mixture of the three colors red, green and blue, is used in second fluorescent film 10, but the present invention is not limited to this form. As long as fluorescent materials that emit different colors are used in first fluorescent film 8 and second fluorescent film 10, the same action and effects as those described in each of the embodiments can be obtained, i.e., the ability to switch the color of the emitted light between two or four colors, and further, the ease of fabrication and control.

In addition, although examples were described in all of the above-described embodiments in which two electrodes, first electrode 6A and second electrode 6B, were provided on rear-surface substrate 1, the present invention is not necessarily limited to this form. For example, it is of course possible for a plurality of each of electrodes that correspond to first electrode 6A and second electrode 6B, i.e., two types of electrodes that allow the application of voltage between the electrodes and that allow both electrodes to be set to the same electric potential, to be formed in an electrode pattern in which the two types of electrodes are alternately arranged.

What is claimed is:

1. A flat noble-gas discharge lamp comprising:

an outer enclosure that comprises:

a flat rear-surface substrate;

a flat front-surface substrate that confronts the rear-surface substrate and that is separated from the rear-surface substrate by a prescribed distance;

a frame member disposed on a perimeter of the flat rear-surface substrate that connects the flat rear-surface substrate to the flat front-surface substrate; and a gas that is hermetically sealed inside the outer enclosure;

a plurality of electrodes provided on at least one of the flat rear-surface substrate and the flat front-surface substrate;

at least one dielectric film that provides a dielectric barrier discharge; and films of fluorescent material provided on an inner surface of said outer enclosure, wherein the application of voltage between a pair among said plurality of electrodes causes a glow discharge based on the dielectric barrier discharge inside said outer enclosure; and ultraviolet rays that are emitted by this glow discharge are converted to visible light by said films of fluorescent material, and extracted through said front-surface substrate to the outside;

wherein said films of fluorescent material comprises a first fluorescent film that is provided on said rear-surface substrate, and a second fluorescent film that is provided on said front-surface substrate and that emits visible light of a color that differs from that of said first fluorescent film.

2. A flat noble-gas discharge lamp according to claim 1, wherein the at least one dielectric film is disposed on at least one of said rear-surface substrate and said front-surface substrate and functions as a dielectric for generating said dielectric barrier discharge.

3. A flat noble-gas discharge lamp according to claim 1, wherein said plurality of electrodes comprises:

a first electrode and a second electrode that are arranged at a distance from each other on said rear-surface substrate; and a third electrode that is provided in an area of said front-surface substrate that confronts said first electrode and said second electrode.

4. A flat noble-gas discharge lamp according to claim 3, wherein said t least one dielectric film comprises a first dielectric film and a second dielectric film, wherein said first electrode and said second electrode are formed on an inner surface of said rear-surface substrate, said first dielectric film that covers said first electrode and said second electrode formed on said rear-surface substrate, and said first fluorescent film is formed to cover said first dielectric film; and wherein said third electrode is formed on an inner surface of said front-surface substrate, said a second dielectric film that covers said third electrode is formed on said front-surface substrate, and said second fluorescent film is formed to cover said second dielectric film.

5. A flat noble-gas discharge lamp according to claim 3, wherein said first electrode and said second electrode are formed on an outer surface of said rear-surface substrate, and said rear-surface substrate functions as a dielectric for generating said dielectric barrier discharge; and said third electrode is formed on an inner surface of said front-surface substrate, said at least one dielectric film covers said third electrode is formed on said front-surface substrate, and said second fluorescent film is formed to cover said at least one dielectric film.

6. A flat noble-gas discharge lamp according to claim 3, wherein:

said first electrode and said second electrode are formed on an inner surface of said rear-surface substrate said at least one dielectric film covers said first electrode and said second electrode is formed on said rear-surface substrate, and said first fluorescent film is formed to cover said at least one dielectric film; and said third electrode is formed on the outer surface of said front-surface substrate, and said front-surface substrate functions as a dielectric for generating said dielectric barrier discharge.

7. A flat noble-gas discharge lamp according to claim 3, wherein said at least one dielectric film comprises said rear-surface substrate and said front-surface substrate.

wherein said first electrode and said second electrode are formed on an outer surface of said rear-surface substrate, said third electrode is formed on an outer surface of said front-surface substrate.

8. A flat noble-gas discharge lamp according to claim 1, wherein said gas that is sealed inside said outer enclosure is a noble gas that does not contain mercury.

9. A flat noble-gas discharge lamp according to claim 8, wherein said gas that is sealed inside said outer enclosure is a gas mixture that contains two types of noble gas that each require the application of a different voltage between said electrode pairs to generate a glow discharge for exciting the corresponding gas and that, when excited, each emit ultraviolet rays of different wavelengths.

10. A flat noble-gas discharge lamp according to claim 9, wherein said gas that is sealed inside said outer enclosure is a gas mixture of xenon and krypton.

11. An illumination device, comprising:

a flat noble-gas discharge lamp according to claim 1;

a power supply device for supplying a voltage including at least one of an alternating-current voltage and a positive-negative bipolar pulse voltage; and an electrical circuit for connecting said plurality of electrodes with said power supply device;

wherein:

said electrical circuit is switchably engaged with electrode pairs each comprising at least two of said plurality of electrodes to determine a position of said glow discharge that is generated when voltage is applied among different positions within a space from said rear-surface substrate to said front-surface substrate.

12. An illumination device according to claim 11, wherein:

said plurality of electrodes includes: a first electrode and a second electrode that are arranged at a distance from each other on said rear-surface substrate, and a third electrode that is provided in a region of said front-surface substrate that confronts said first electrode and said second electrode; and said electrical circuit is configured to switch the voltage of said power supply device between two states, said voltage in one state being applied between said first electrode and said second electrode, and said voltage in another state being applied between said first and said second electrodes and said third electrode.

13. An illumination device according to claim 11, wherein:

said gas that is sealed inside said outer enclosure is a gas mixture that contains a first noble gas and a second noble gas that each require the application of a different voltage between said electrode pairs to generate a glow discharge for exciting the corresponding gas and that, when excited, each emit ultraviolet rays of different wavelengths;

said power supply device configured to switch the voltage between a high level and a low level for generating a glow discharge in which one of said first noble gas and said second noble gas is excited.

14. A method of lighting a flat noble-gas discharge lamp according to claim 11; comprising selectively executing steps of:

applying an alternating-current voltage to a first pair of said electrode pairs; and applying an alternating-current voltage to a second pair of said electrode pairs different from said first pair.

15. A lighting method according to claim 14, comprising:

using said flat noble-gas discharge lamp having, as said plurality of electrodes, a first electrode and a second electrode that are arranged at a distance from each other on said rear-surface substrate and a third electrode that is provided on an area of said front-surface substrate that confronts said first electrode and said second electrode;

selectively executing one of steps of:

applying an alternating-current voltage between said first electrode and said second electrode; and placing said first electrode and said second electrode at the same electric potential and applying an alternating-current voltage between said first and second electrodes and said third electrode.

16. A lighting method according to claim 15, comprising:

using said flat noble-gas discharge lamp that uses, as said gas that is sealed inside said outer enclosure, a gas mixture that contains two types of noble gas that each require the application of a different voltage between said electrode pairs to generate a glow discharge for exciting the corresponding gas and that, when excited, each emit ultraviolet rays of different wavelengths;

selectively executing one of:

a first step of applying an alternating-current voltage between said first electrode and said second electrode;

a second step of applying an alternating-current voltage having a voltage value that is different from said alternating-current voltage in said first step between said first electrode and said second electrode;

a third step of making said first electrode and said second electrode the same electric potential and applying an alternating-current voltage between said first and second electrodes and said third electrode; and a fourth step of making said first electrode and said second electrode the same electric potential and applying an alternating-current voltage having a voltage value that is different from said alternating-current voltage in said third step between said first and second electrodes and said third electrode.

* * * * *